US008459315B2

(12) United States Patent
Clüsserath et al.

(10) Patent No.: US 8,459,315 B2
(45) Date of Patent: Jun. 11, 2013

(54) FILLING SYSTEM FOR FILLING BEVERAGE BOTTLES IN A BEVERAGE BOTTLING PLANT

(75) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 569 days.

(21) Appl. No.: 12/624,090

(22) Filed: Nov. 23, 2009

(65) Prior Publication Data

US 2010/0132834 A1 Jun. 3, 2010

Related U.S. Application Data

(63) Continuation-in-part of application No. PCT/EP2008/003404, filed on Apr. 26, 2008.

(30) Foreign Application Priority Data

May 22, 2007 (DE) ..... 10 2007 024 106

(51) Int. Cl.
*B65B 1/04* (2006.01)

(52) U.S. Cl.
USPC ..... 141/90; 141/82; 141/145; 141/290; 141/302; 222/148; 222/424

(58) Field of Classification Search
USPC ..... 141/82, 85, 90, 128, 144, 145, 165, 141/285, 290, 301, 302; 222/148, 424
See application file for complete search history.

(56) References Cited

U.S. PATENT DOCUMENTS

| | | | | |
|---|---|---|---|---|
| 5,562,129 | A * | 10/1996 | Graffin | 141/90 |
| 6,267,157 | B1 * | 7/2001 | Gruson et al. | 141/90 |
| 7,243,483 | B2 * | 7/2007 | Clusserath et al. | 53/473 |

FOREIGN PATENT DOCUMENTS

| | | | |
|---|---|---|---|
| DE | 196 46 595 | A1 | 5/1998 |
| DE | 201 05 716 | U1 | 5/2002 |
| EP | 1 215 166 | A | 6/2002 |

OTHER PUBLICATIONS

International Search Report PCT/EP2008/003404 and English translation thereof.

* cited by examiner

*Primary Examiner* — Gregory Huson
*Assistant Examiner* — Jason K Niesz
(74) *Attorney, Agent, or Firm* — Nils H. Ljungman & Associates

(57) ABSTRACT

Container filling arrangement in which a first flow channel connects a first portion of a liquid channel, adjacent a liquid valve, and a collecting channel. A second flow channel connects the first flow channel and a second portion of the liquid channel adjacent a dispensing opening. A first valve in the first flow channel may be closed upon the liquid valve being opened during container filling, and is designed to be forced open by an increase to a first pressure in the first flow channel generated by a closing of the liquid valve. The second valve is designed to be closed until forced open by an increase to a second pressure, greater than the first pressure, in the first and second flow channels. The second pressure may be generated during a cleaning and/or sterilizing of the container filling arrangement.

20 Claims, 5 Drawing Sheets

FILLING SYSTEM FOR FILLING BEVERAGE BOTTLES IN A BEVERAGE BOTTLING PLANT

CONTINUING APPLICATION DATA

This application is a Continuation-In-Part application of International Patent Application No. PCT/EP2008/003404, filed on Apr. 26, 2008, which claims priority from Federal Republic of Germany Patent Application No. 10 2007 024 106.4, filed on May 22, 2007. International Patent Application No. PCT/EP2008/003404 was pending as of the filing date of this application. The United States was an elected state in International Patent Application No. PCT/EP2008/003404.

BACKGROUND

1. Technical Field

The present application relates to a filling system for filling beverage bottles in a beverage bottling plant.

2. Background Information

Background information is for informational purposes only and does not necessarily admit that subsequently mentioned information and publications are prior art.

The present application relates to a filling system of a filling machine for hot filling of bottles or similar containers. The filling system comprises at least one filling element, with a liquid channel fashioned in a housing of the filling element. The liquid channel communicates on the one hand with a kettle for the liquid fill product and on the other hand forms a dispensing region for dispensing the liquid product into the respective container. The filling element comprises a liquid valve in the liquid channel, which can be controlled between a closed state and at least one opened state.

Filling systems, for example also those for the filling of bottles or similar containers with a hot liquid product, i.e., for hot bottling of, e.g., still beverages or other products, are familiar. In these systems it is necessary and/or desired, or at least possible, to keep the filling elements warm and/or at least heat them during fill intermissions in order to avoid, restrict, and/or minimize cooldown of the filling elements and to essentially guarantee or promote, e.g., the temperature of the filling product necessary and/or desired for a hot sterile bottling when it is placed into the container.

OBJECT OR OBJECTS

An object of the present application is to indicate a filling system which enables, for a simplified design of the filling element, a heating and/or a keeping warm of the filling elements of a filling machine in pauses between fills thanks to a hot circulation of the hot fill product, but also a CIP cleaning and/or sterilization.

SUMMARY

To solve this object, the present application discloses a filling system of a filling machine for hot filling of bottles or similar containers comprising at least one filling element, with a liquid channel fashioned in a housing of the filling element. The liquid channel communicates on the one hand with a kettle for the liquid fill product and on the other hand forms a dispensing region for dispensing the liquid product into the respective container. The filling element comprises a liquid valve in the liquid channel, which can be controlled between a closed state and at least one opened state. A first flow channel may be fashioned in the housing of the filling element, which connects a segment of the liquid channel in the direction of flow upstream from the liquid valve to a collecting channel in common for several filling elements. A second flow channel may be fashioned in the housing of the filling element, by which the collecting channel can be connected to a rinsing space comprising the dispensing region for a cleaning and/or sterilization of the filling system. There is provided, in the first flow channel as well as the second flow channel, a valve controlled by the pressure at least in the respective flow channel, of which the at least one first valve provided in the first flow channel automatically opens the first flow channel when the liquid valve is closed and automatically closes it when the liquid valve is opened. The at least one second valve provided in the second flow channel closes the second flow channel both when the liquid valve is opened and closed and opens it automatically at a pressure which is greater than a pressure of the fill product against the second valve during the filling.

Modifications, benefits and possible applications of the present application will emerge from the following description of sample embodiments and from the figures. The features described and/or graphically depicted are essentially in themselves or in any given combination an object of the present application, regardless of being summarized in the claims or referred back to them.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application will be explained more closely below by means of the figures on a sample embodiment. This shows.

DESCRIPTION OF EMBODIMENT OR EMBODIMENTS

Figure 1:
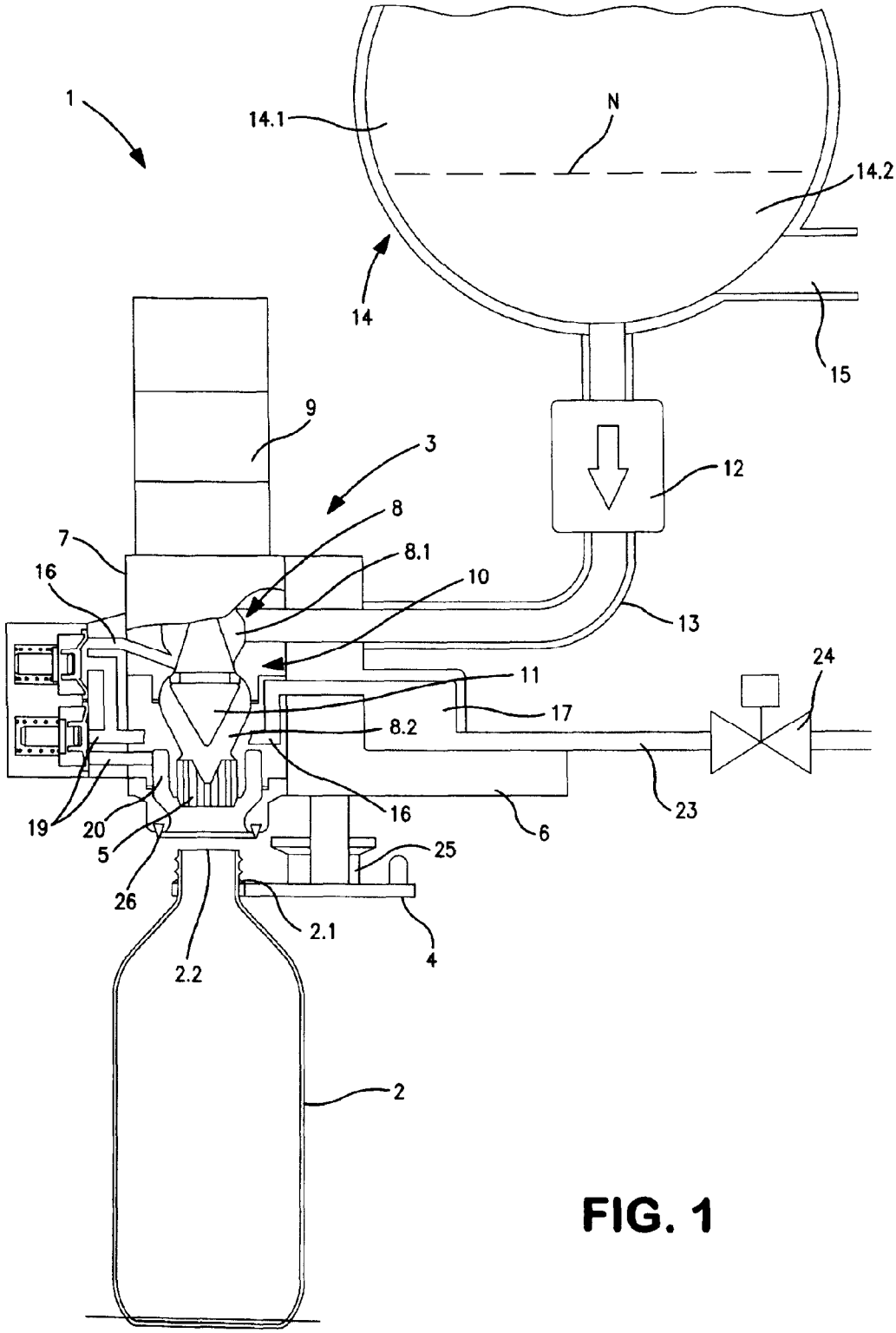
FIG. 1 in simplified representation and partly in section view, a filling system according to the present application for filling of bottles or similar containers with a liquid product, with the liquid valve closed.

The filling system generally designated as 1 in the figures is part of a filling machine, for example, a filling machine of rotating design for the free-stream filling of bottles 2 with a hot liquid product (hot free-stream filling). The filling system 1 comprises filling elements 3 as well as bottle or container holders 4 beneath each filling element 3 for suspension of the bottle 2 from a flange 2.1 formed on the bottle neck, so that the bottle mouth 2.2 lies at a distance and opposite a dispensing region of the filling element 3, formed by a gas lock 5. A plurality of filling elements 3 and container holders 4 is provided on the circumference of a rotor 6, able to be driven in rotation about a vertical machine axle.

In the housing 7 of each filling element 3 there is provided a liquid channel 8 for the liquid product, and having a liquid valve 10 controlled by an activating mechanism 9, which is basically formed by a valve body 11 interacting with a valve seat. The liquid valve 10 or its valve body 11 are shown in the closed position in FIG. 1, so that the liquid channel 8 in this operating condition is divided into two separate segments 8.1 and 8.2, the upper segment 8.1 being connected by a line 13 having a flow meter 12 to a kettle 14. The kettle 14 is provided in common for the filling elements 3 and during the filling operation it is partly filled with the liquid product, i.e., up to a controlled level N, so that a gas space 14.1 is formed in the kettle 14 above the level N, which lies distinctly above the height level of the dispensing region provided with the gas lock 5, and beneath this is formed a liquid space 14.2, into which emerge at the bottom the line 13 as well as a line 15 for supplying the liquid fill product.

The segment 8.2 of the liquid channel forms at its lower end the dispensing region provided with the gas lock 5. The gas lock 5 in the embodiment depicted is an insert piece with a plurality of channels open at both ends.

Thanks to the activating mechanism 9, the valve body 11 can be moved from the closed position in the direction of the gas lock 5 for the opening of the liquid channel 10, and this into at least two different opening positions, namely, a first opening position in which the liquid valve 10 is opened with a reduced opening cross section for a braked or slow filling, and a second opening position in which the liquid valve 10 is opened with a larger opening cross section for a fast filling.

Furthermore, a flow pathway 16 is formed in the housing 7 of the filling element 3, which connects the segment 8.1 to an annular channel 17, which is provided in common for the filling elements 3 or for a group of filling elements 3 of the filling machine. A valve 18 is provided in the flow pathway 16, comprising essentially a valve plunger 18.1 pretensioned by a compression spring in the valve closing position and a membrane 18.2 forming the valve body, and designed so that it opens in the manner of a pressure limiting valve at a pressure P1, in one possible embodiment also for a flow in the flow channel 16 from the segment 8.1 into the annular channel 17.

Furthermore, a flow channel 16 is formed in the housing 7 of the filling element 3, joining the segment of the flow channel 16 between the valve 18 and the annular channel 17 to a space 20 formed inside a bell-shaped element 21, provided at the bottom of the housing 7 and being open at the bottom of the filling element 3 during the filling operation (opening 21.1). The dispensing region formed by the gas lock 5 is accommodated in the space 20.

A valve 22 is provided in the flow channel 19, fashioned identical to the valve 18, and comprising essentially a valve plunger 22.1 pretensioned by a compression spring in the valve closing position and a membrane 22.2 forming the valve body, and designed so that it opens in the manner of a pressure limiting valve at a pressure P2. The annular channel 17 is connected to a line 23 which is part of a hot circulation for the liquid fill product and in which an electrically operated control valve 24 is arranged.

The most diverse modes of operation are possible with the filling system 1.

Filling Operation with Heating and/or Keeping Warm of the Filling Elements 3

FIG. 1 shows the filling element 3 in the closed condition, i.e., in a pause between fills, for example, after the end of one filling phase or after the end of the filling of a bottle 2 and before the start of a new filling phase after an empty bottle 2 has been placed in the container holder 4.

The control valve 24 in common for the filling elements 3 or for a group of filling elements 3 is generally opened during the hot filling, so that the hot liquid product can flow in a hot circulation through the filling elements 3 of the filling machine that happen to be in the closed condition, this circulation including the kettle 14, the line 13, the segment 8.1, the flow channel 16, the annular channel 17, the line 23, and a heating layout for the fill product (not shown), from which the fill product is supplied by the line 15 to the kettle 14. To make possible this hot air circulation that results in the heating and/or keeping warm of the filling elements 3, the valve 18 of each filling element 3 is adjusted so that, with the liquid channel 8 or the liquid valve 10 closed, the valve 18 is opened by the rising pressure of the fill product P1, but it closes when the liquid channel 8 or liquid valve 10 is opened.

Opening of the liquid valve 10 initiates the filling phase, for which the valve body 10 is moved into its second opening position by the activating mechanism 9 for a fast filling, for example. The hot liquid product then flows as a free stream from the dispensing region formed by the gas lock 5 into the bottle 2, also kept at a distance from the opening 21.1 by its bottle mouth 2.2. The quantity of fill product flowing into the bottle 2 is metered by the flow meter 12, which sends a signal corresponding to this quantity to a central control mechanism of the filling machine. Before the filling phase is ended, a braked or slow filling is carried out, taking into account the signal sent by the flow meter 12. For this, the valve body 11 is moved by the activating mechanism 9 to its first opening position with reduced opening cross section, so that the liquid product then flows more slowly but still in a free stream into the bottle 2.

During the fast filling and the slow filling, the pressure of the liquid product occurring at the valve 18 is reduced so much that the valve 18 is closed. A contributing factor to this is also the fact that the flow channel 16 has a reduced flow cross section as compared to the opened liquid channel 8 and emerges at a slant into an annular gap with reduced flow cross section, formed between the valve body 11 and the wall of the liquid channel 8, so that the pressure of the liquid product acting on the valve 18 is reduced in a kind of Venturi effect by the fill product flowing through the liquid channel 8 and into the bottle 2. The Venturi effect is the reduction in fluid pressure that results when a fluid flows through a constricted section of pipe.

Due to the fact that the valve 18 closes by itself when the liquid valve 10 opens, the hot circulation moving across the flow channel 16 is interrupted during the filling process, so that a proper measurement of the fill product supplied to the bottle 2 is possible with the flow meter 12, and the bottles 2 can be filled to correct volume with the liquid product. Furthermore, thanks to the described configuration of the flow channel 16 and the valve 18 there, neither is it necessary and/or desired to provide a control valve in the flow channel 16 that is actuated by the control electronics of the filling machine.

The valve 22 is configured so that it is blocked by the pressure P1 occurring during the filling process. The filling process is ended by closing of the liquid valve 10, as a result of which the pressure P1 occurring on the valve 18 is again sufficient to open this valve and thereby make possible the hot circulation of the hot liquid product.

Figure 1A:
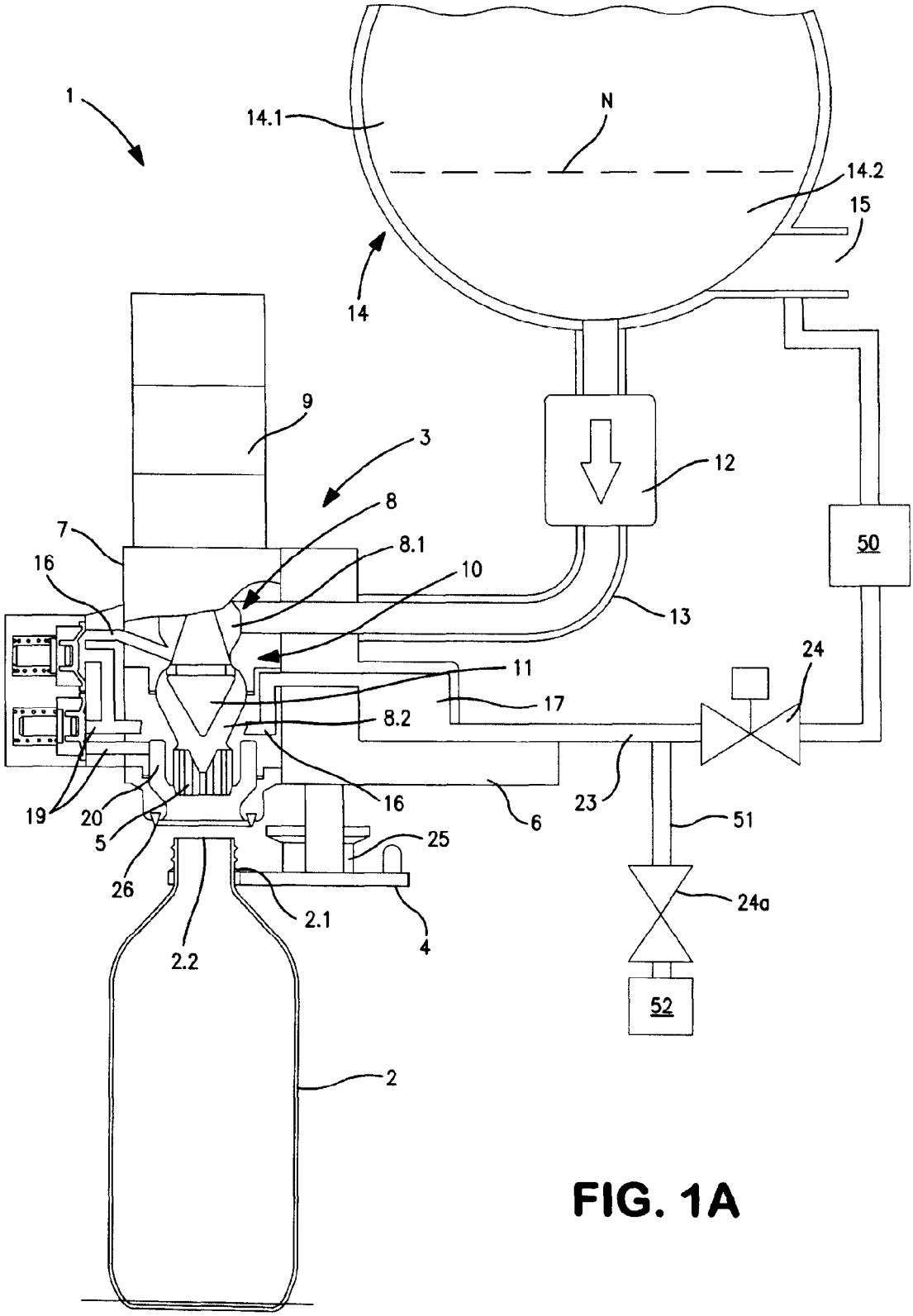
FIG. 1A a filling system similar to that of FIG. 1.
Figure 2:
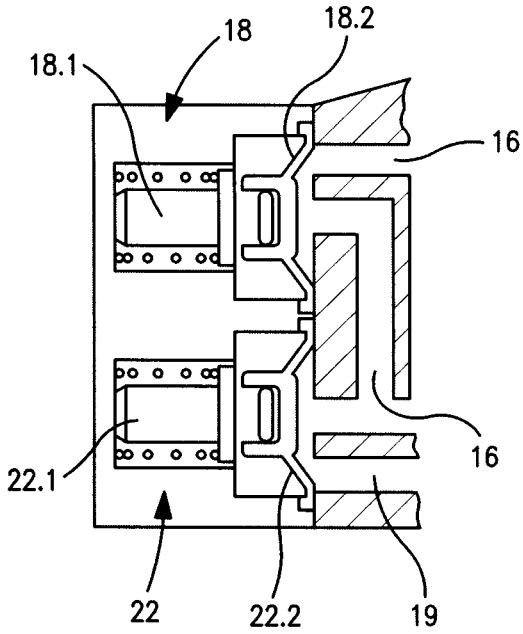
FIG. 2 in detail view, two pressure-operated valves of a filling element of the filling system of FIG. 1.

FIG. 1A shows one possible embodiment of the present application, similar to that which can be seen in FIG. 1. An addition to those features of FIG. 1, FIG. 1A also may include a line 51, which may run from line 23 to a storage arrangement or sewer arrangement 52. A valve 24*a* promotes or minimizes the flow through line 51. Cleaning medium may flow through the line 51 and out of the filling system 1, and into either a storage system or a sewer system 52, for the removal of cleaning or treatment medium from the filling system 1.

In another possible embodiment the hot liquid beverage material may run through the line 23, through the valve 24, and through the line 50 into the line 15 and/or kettle or reservoir 14. Line 50 may complete the circuit between the filling element 3 and the reservoir 14 for the circulation of hot liquid beverage material. Additionally, cleaning or treatment medium may be circulated through the filling system 1 with line 50.

CIP Cleaning and/or Sterilization

Figure 3:
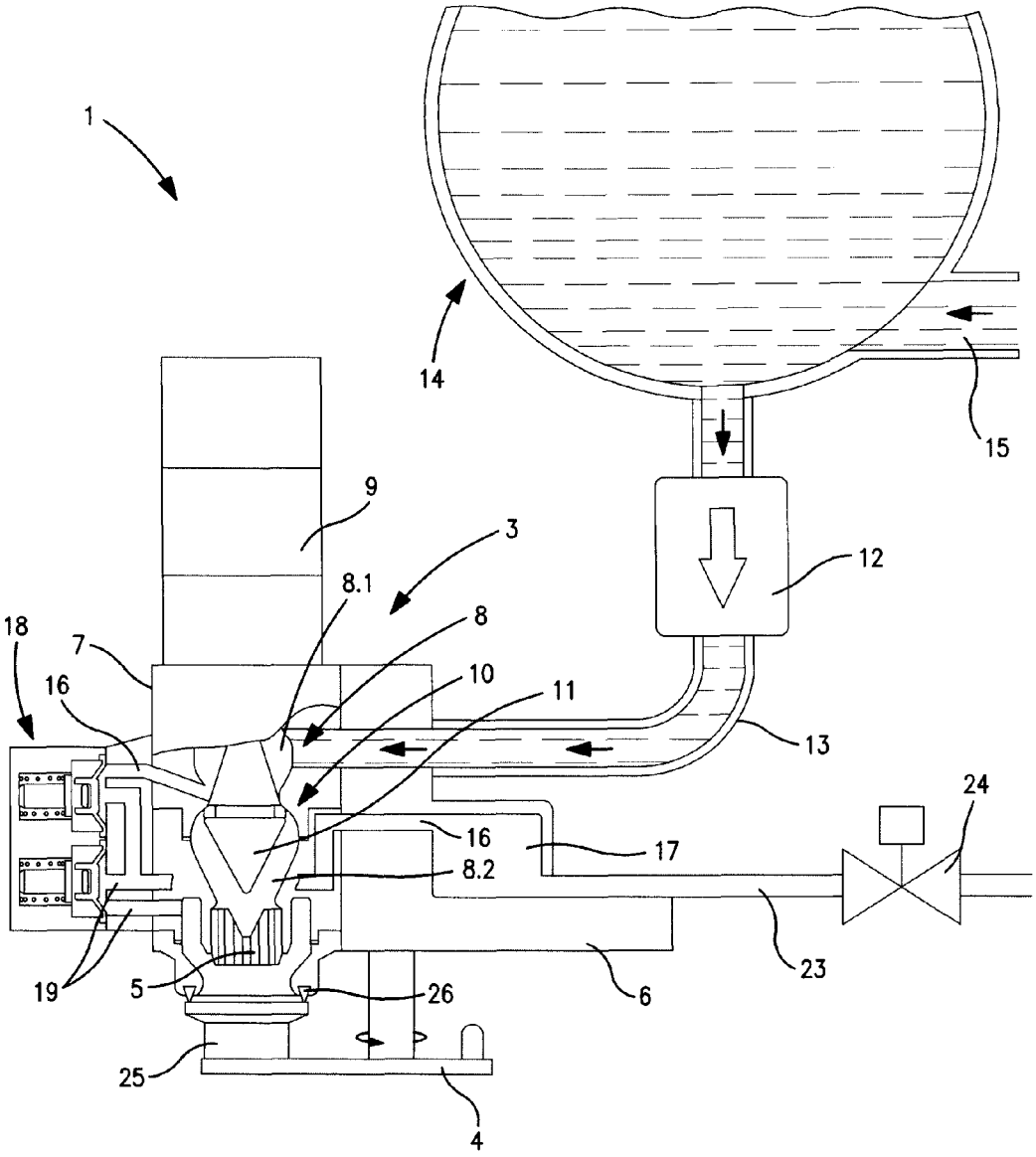
FIG. 3 the filling system of FIG. 1 in an operating state for a CIP cleaning and/or sterilization.

FIG. 3 shows the filling system 1 in an operating state for a CIP cleaning and/or sterilization. For this, by swiveling of the container holder 4 a closure cap 25 provided on this container holder is placed at the bottom of the filling element 3 and pressed there against a gasket ring 26 encircling the opening 21.1, in order to close the space 20 and form a tight rinsing space on the bottom of each filling element 3.

When the liquid valve 10 is fully open, i.e. the valve body 11 is in the second opening position, the liquid cleaning or sterilization medium used for the CIP cleaning and/or sterilization is supplied to the kettle 14 across the line 15 with a pressure P2 such that the cleaning and/or sterilization medium completely fills up the interior of the kettle 14. Thanks to the pressure P2 of the cleaning or sterilization medium, which is substantially higher than the pressure P1, both valve 18 and 22 are opened, so that the cleaning or sterilization medium can flow through the filling elements 3, i.e., it flows by the respective line 13 to the liquid channel 8 and, flowing through this liquid channel 8, partly via the flow channel 16 and partly via the dispensing region or the gas lock 5, across the rinsing space 20 closed off from the outside and across the flow channel 19, it arrives at the annular channel 17, from which the cleaning or sterilization medium is drained off across the line 23 with the valve 24 opened.

Thanks to the described configuration of the flow channel 19 and its valve 22, neither is it necessary and/or desired to provide a control valve in the flow channel 19 that is actuated by the control electronics of the filling machine. Thus, each filling element makes do with a single activating element 9, actuated by the control electronics of the filling machine, with two servo-elements or cylinders, for example.

The valve 18 is essentially controlled by the pressure in the segment 8.1 of the liquid channel 8 and the valve 22 by the pressure in the space 20, at least upon opening of the respective valve, since these pressures act on the larger surface of the membrane 18.2 or 22.2 forming the valve body when the respective valve is closed.

The described valves 18 and 22, in one possible embodiment with the membrane-type valve body, have the benefit that the function of these valves is not impaired by fibrous and/or solid substances, which are often in liquid filling product, such as fruit juices.

In at least one possible embodiment of the present application, sterilization or treatment of the filling system may begin by placing a closure cap 25 in sealing engagement with the opening 21.1 of the filling element 3. Once the cap or seal 25 is in place, the kettle or reservoir 14 may be filled with a treatment or sterilizing or cleaning medium, in one possible embodiment filled completely or substantially completely. The treatment fluid may then be flowed through the line 13, the flow meter 12, the liquid channel 8, segments 8.1 and 8.2, the liquid valve 10, the flow channel 16, the valve 18, the gas lock 5, the flow channel 19, the valve 22, the annular channel 17, the line 23, and the electrically operated valve 24. The pressure P2 of the cleaning medium being run through the filling system 1 and filling element 3 is higher than the pressure P1 of the beverage or liquid beverage material. The pressure P2 is sufficiently high to open both valves 18 and 22. The pressure P1 is sufficiently high to open valve 18, but is not sufficiently high to open valve 22.

Figure 4:
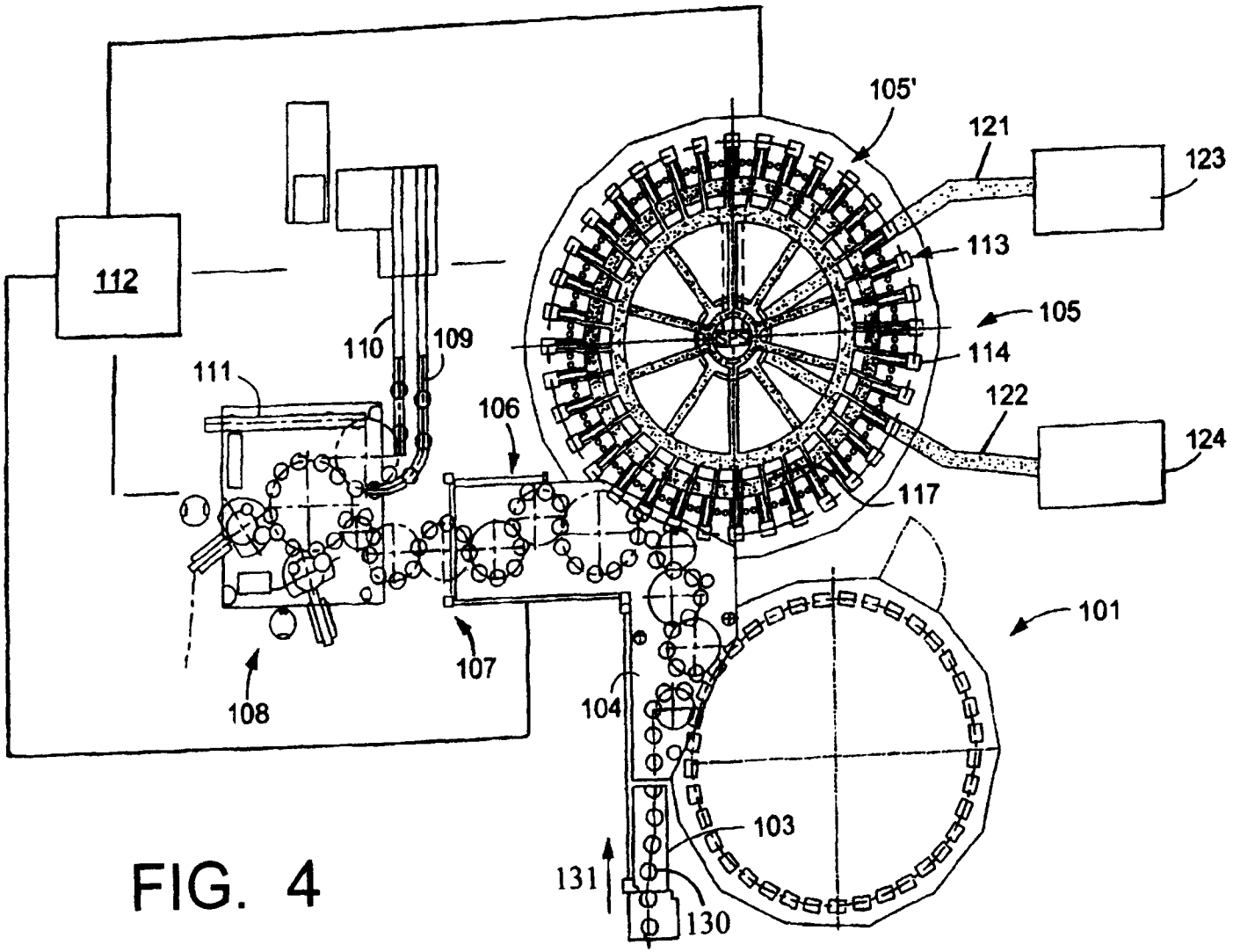
FIG. 4 shows schematically the main components of one possible embodiment example of a system for filling containers, in one possible embodiment a beverage bottling plant for filling bottles with at least one liquid beverage, in accordance with at least one possible embodiment, in which system or plant could possibly be utilized at least one aspect, or several aspects, of the embodiments disclosed herein.

FIG. 4 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 4, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application has been described above by a sample embodiment. Of course, changes and modifications are possible, without thereby leaving the basic notion of the present application.

It was assumed above that the valves 18 and 22 correspond at least in terms of their action to pressure limiting valves, i.e., the valve 18 opens at the pressure P1 of the filling product arising when the liquid valve 10 is closed, being essentially equal to the hydrostatic pressure based on the height difference between the level N of the liquid product in the kettle 14 and the height position of the valve 18, while valve 22 opens at the much higher pressure P2 of the cleaning and/or sterilization medium during the CIP cleaning and/or sterilization.

Basically, the possibility also exists of using other valve types for the valves 18 and 22, such as check valves, or even such valves as respond to a pressure difference between the valve inlet and the valve outlet and then open or close if this pressure difference goes above or below a given threshold value.

Filling system of a filling machine for hot filling of bottles or similar containers, with at least one filling element, with a liquid channel fashioned in a housing of the filling element, which communicates on the one hand with a kettle for the liquid fill product and on the other hand forms a dispensing region for dispensing the liquid product into the respective container, and with a liquid valve in the liquid channel, which can be controlled between a closed state and at least one opened state.

One feature or aspect of an embodiment is believed at the time of the filing of this patent application to possibly reside broadly in a filling system of a filling machine for hot filling of bottles or similar containers 2, with at least one filling element 3, with a liquid channel 8 fashioned in a housing 7 of the filling element 3, which communicates on the one hand with a kettle 14 for the liquid fill product and on the other hand forms a dispensing region 5 for dispensing the liquid product into the respective container 2, and with a liquid valve 10 in the liquid channel 8, which can be controlled between a closed state and at least one opened state, wherein a first flow channel 16 fashioned in the housing 7 of the filling element 3, which connects a segment 8.1 of the liquid channel in the direction of flow upstream from the liquid valve 10 to a collecting channel 17 in common for several filling elements 3, and by a second flow channel 19 fashioned in the housing 7 of the filling element 3, by which the collecting channel 17 can be connected to a rinsing space 20 containing the dispensing region 5 for a cleaning and/or sterilization of the filling system 1, wherein there is provided in the first as well as the second flow channel 16, 19 a valve 18, 22 controlled by the pressure at least in the respective flow channel 16, 19, of which the at least one first valve 18 provided in the first flow channel 16 automatically opens the first flow channel 16 when the liquid valve 10 is closed and automatically closes it when the liquid valve 10 is opened, and the at least one second valve 22 provided in the second flow channel 19 closes the second flow channel 19 both when the liquid valve 10 is opened and closed and opens it automatically only at a pressure P2 which is greater than a pressure P1 of the fill product against the second valve 22 during the filling.

Another feature or aspect of an embodiment is believed at the time of the filing of this patent application to possibly reside broadly in the filling system, wherein the collecting channel 17 and at least one line 23 connected to this channel with a control or servo-valve 24 is part of a circulation for the hot fill product, in which, when the liquid valve 10 is closed, the first segment of the liquid channel 8 as well as the opened first flow channel 16 are involved in the heating and/or keeping warm of the filling element 3.

Yet another feature or aspect of an embodiment is believed at the time of the filing of this patent application to possibly reside broadly in the filling system, wherein the first valve 18 and/or the second valve are a check valve or a valve working similar to a check valve.

Still another feature or aspect of an embodiment is believed at the time of the filing of this patent application to possibly reside broadly in the filling system, wherein the first valve 18 and/or the second valve 22 are a pressure limiting valve or a valve working similar to a pressure limiting valve.

A further feature or aspect of an embodiment is believed at the time of the filing of this patent application to possibly reside broadly in the filling system, wherein the first valve 18 and/or the second valve 22 are a valve that opens and closes when a pressure difference between a valve inlet and a valve outlet goes above or below a threshold value.

Another feature or aspect of an embodiment is believed at the time of the filing of this patent application to possibly reside broadly in the filling system, wherein the liquid valve 10 can be controlled between a closed state and at least a first opening state with reduced opening cross section for a braked filling and at least one second opening state with enlarged opening cross section for a fast filling.

Yet another feature or aspect of an embodiment is believed at the time of the filing of this patent application to possibly reside broadly in the filling system, wherein a space 20 is provided at the dispensing region 5, receiving this dispensing region 5 and open at the bottom of the filling element 3, which can be closed by a closure element 25 to form the rinsing space, and into which the second flow channel 19 empties.

Still another feature or aspect of an embodiment is believed at the time of the filing of this patent application to possibly reside broadly in the filling system, wherein a gas lock 5 is provided in a segment 8.2 of the liquid channel downstream from the liquid valve 10.

A further feature or aspect of an embodiment is believed at the time of the filing of this patent application to possibly reside broadly in the filling system, wherein the gas lock 5 forms the dispensing region.

Another feature or aspect of an embodiment is believed at the time of the filing of this patent application to possibly reside broadly in the filling system, wherein the container holder 4 is designed for a suspended fastening of the particular container 2 being filled.

Yet another feature or aspect of an embodiment is believed at the time of the filing of this patent application to possibly reside broadly in an element 25 forming and/or sealing the rinsing space 20 is provided on the container holder 4.

Still another feature or aspect of an embodiment is believed at the time of the filing of this patent application to possibly reside broadly in the filling element 3 is designed for a free-stream filling.

One feature or aspect of an embodiment is believed at the time of the filing of this patent application to possibly reside broadly in a rotary beverage bottle filling system being configured to fill beverage bottles with a hot liquid beverage material in a beverage bottling plant, which rotary beverage bottle filling system is configured to permit substantially continuous flow of hot liquid beverage material upon a beverage bottle being filled and prior to a new, empty beverage bottle being disposed below a filling element, said rotary beverage bottle filling system comprising: a reservoir being configured and disposed to supply a flow to said rotary beverage bottle filling system; said reservoir being configured to hold: a level of hot liquid beverage material; a level of treatment medium, which level of treatment medium is greater than the level of hot liquid beverage material; at least one filling element being configured and disposed to fill beverage bottles with hot liquid beverage material; said at least one filling element comprising a housing; a liquid channel being configured and disposed to supply a flow from said reservoir to said at least one filling element; a filling valve being disposed in said liquid channel and being configured to be moved into: a closed position, in which the flow of liquid is substantially minimized; a first open position, in which a first flow is permitted through said filling valve; and a second open position, in which a second flow is permitted through said filling valve, which second flow is greater than the first flow; said liquid channel comprising a first portion and a second portion, which first portion is disposed upstream of said second portion in the direction of flow; a gas lock being configured and disposed to: permit a flow from said filling valve; and minimize dripping upon said filling valve being in the closed position; a dispensing area being disposed downstream of said gas lock and being configured to permit a flow from said gas lock; said dispensing area comprising a dispensing opening being disposed below said gas lock and being configured to: permit a flow of hot liquid beverage material out of said at least one filling element upon said dispensing opening being open and unobstructed; and restrict a flow of treatment medium out of said filling element upon said dispensing opening being closed; a rinsing space being disposed adjacent said dispensing area and substantially about said gas lock; an annular collecting channel being configured and disposed to receive a flow from said filling element; a pumping arrangement being configured and disposed to promote a flow from said annular collecting channel to said reservoir; a first one-way valve being configured and disposed to permit: a flow from said first portion of said liquid channel to said annular collecting channel upon at least a first pressure being reached in said first portion of said liquid channel; and circulation of hot liquid beverage material from said at least one filling element back to said reservoir upon said filling valve being closed; a first channel being disposed in said housing of said at least one filling element and being configured to permit a flow between said first portion of said liquid channel to said first one-way valve; a second one-way valve being configured and disposed to permit a flow from said rinsing space to said annular collecting channel upon said dispensing opening being closed; a second channel being disposed in said housing of said at least one filling element and being configured to permit a flow between said dispensing area to said second one-way valve; said first channel and said second channel being configured and disposed to further permit a flow from said first one-way valve and said second one-way valve to said annular collecting channel upon said dispensing opening being closed; said first one-way valve being configured to open upon: said filling valve being closed; hot liquid beverage material reaching a first pressure in said first portion of said liquid channel and said first channel and remain open at a higher pressure; and said second one-way valve being configured to open upon: said dispensing opening being closed; and treatment medium reaching a second pressure in said rinsing space and said second channel, which second pressure is higher than the first pressure.

Another feature or aspect of an embodiment is believed at the time of the filing of this patent application to possibly reside broadly in the rotary beverage bottle filling system, wherein said beverage bottle filling system further comprises: at least one line configured and disposed to receive a flow from said annular collecting channel; a valve disposed on said at least one line configured and disposed to permit circulation of hot liquid beverage material upon: said filling valve being in the closed position; and said first one-way valve being open.

Yet another feature or aspect of an embodiment is believed at the time of the filing of this patent application to possibly reside broadly in the rotary beverage bottle filling system, wherein said first one-way valve and/or said second one-way valve each comprise a check valve or a valve working similar to a check valve.

Still another feature or aspect of an embodiment is believed at the time of the filing of this patent application to possibly reside broadly in the rotary beverage bottle filling system, wherein said first one-way valve and/or said second one-way valve each comprise a pressure limiting valve or a valve working similar to a pressure limiting valve.

A further feature or aspect of an embodiment is believed at the time of the filing of this patent application to possibly reside broadly in the rotary beverage bottle filling system, wherein: said first one-way valve and/or said second one-way valve each comprise a valve that opens and closes when a pressure difference between a valve inlet and a valve outlet goes above or below a threshold value; said dispensing opening is configured to be closed by a closure element to form said rinsing space, into which rinsing space said second channel empties; said gas lock is disposed in said second portion of said liquid channel downstream from said filling valve; said beverage bottle filling system further comprises at least one beverage bottle holder, which beverage bottle holder is configured to suspend a beverage bottle being filled; said at least one container holder comprises an element configured to form and/or seal said rinsing space; and said at least one filling element is configured to fill beverage bottles with an open stream of hot liquid beverage material.

Another feature or aspect of an embodiment is believed at the time of the filing of this patent application to possibly reside broadly in a container filling system being configured to fill containers with a hot liquid material in a container filling plant, said container filling system comprising: a reservoir being configured and disposed to supply a flow to said container filling system; said reservoir being configured to hold: a level of hot liquid material; a level of treatment medium during cleaning or sterilization of said container filling system, which level of treatment medium is greater than the level of hot liquid material; at least one filling element being configured and disposed to fill containers with hot liquid material; a liquid channel being configured and disposed to supply a flow from said reservoir to said at least one filling element; a filling valve being disposed in said liquid channel and being configured to be moved into at least: a closed position, in which the flow of liquid is substantially minimized; and a first open position, in which a first flow is permitted through said filling valve; said liquid channel comprising a first portion and a second portion, which first portion is disposed upstream of said second portion in the direction of flow; a dispensing area comprising a dispensing opening being disposed and configured to: permit a flow of hot liquid material out of its said at least one filling element upon said dispensing opening being open and unobstructed; and restrict a flow of treatment medium out of its said filling element upon said dispensing opening being closed; a rinsing space being disposed adjacent said dispensing area; an annular collecting channel being configured and disposed to receive a flow from said filling element; a first one-way valve being configured and disposed to permit: a flow from said first portion of said liquid channel to said annular collecting channel upon at least a first pressure being reached in said first portion of said liquid channel; and circulation of hot liquid material from said at least one filling element back to said reservoir upon said filling valve being closed; a first channel being configured and disposed to permit a flow between said first portion of said liquid channel to said first one-way valve; a second one-way valve being configured and disposed to permit a flow from said rinsing space to said annular collecting channel upon said dispensing opening being closed; a second channel being configured and disposed to permit a flow between said dispensing area to said second one-way valve; said first channel and said second channel being configured and disposed to further permit a flow from said first one-way valve and said second one-way valve to said annular collecting channel upon said dispensing opening being closed; said first one-way valve being configured to open upon: said filling valve being closed; and hot liquid material reaching a first pressure in said first portion of said liquid channel and said first channel and remain open at a higher pressure; and said second one-way valve being configured to open upon: said dispensing opening being closed; and treatment medium reaching a second pressure in said rinsing space and said second channel, which second pressure is higher than the first pressure.

Yet another feature or aspect of an embodiment is believed at the time of the filing of this patent application to possibly reside broadly in the container filling system, wherein said container filling system further comprises: at least one line configured and disposed to receive a flow from said annular collecting channel; a valve disposed on said at least one line configured and disposed to permit circulation of hot liquid material upon: said filling valve being in the closed position; and said first one-way valve being open.

Still another feature or aspect of an embodiment is believed at the time of the filing of this patent application to possibly reside broadly in the container filling system, wherein said first one-way valve and/or said second one-way valve each comprise a check valve or a valve working similar to a check valve.

A further feature or aspect of an embodiment is believed at the time of the filing of this patent application to possibly reside broadly in the container filling system, wherein said first one-way valve and/or said second one-way valve each comprise a pressure limiting valve or a valve working similar to a pressure limiting valve.

Another feature or aspect of an embodiment is believed at the time of the filing of this patent application to possibly reside broadly in the container filling system, wherein said first one-way valve and/or said second one-way valve each comprise a valve that opens and closes when a pressure difference between a valve inlet and a valve outlet goes above or below a threshold value.

Yet another feature or aspect of an embodiment is believed at the time of the filing of this patent application to possibly reside broadly in the container filling system, wherein said filling valve is further configured to be moved into a second open position, in which a second flow is permitted through said filling valve, which second flow is greater than the first flow.

Still another feature or aspect of an embodiment is believed at the time of the filing of this patent application to possibly reside broadly in the container filling system, wherein said dispensing opening is configured to be closed by a closure element to form said rinsing space, into which rinsing space said second channel empties.

A further feature or aspect of an embodiment is believed at the time of the filing of this patent application to possibly reside broadly in the container filling system, wherein said dispensing area comprises a gas lock disposed in said second portion of said liquid channel downstream from said filling valve.

One feature or aspect of an embodiment is believed at the time of the filing of this patent application to possibly reside broadly in the container filling system, wherein said container filling system further comprises at least one container holder, which container holder is configured to suspend a container being filled.

Another feature or aspect of an embodiment is believed at the time of the filing of this patent application to possibly reside broadly in the container filling system, wherein: said at least one container holder comprises an element configured to form and/or seal said rinsing space; and said at least one filling element is configured to fill containers with an open stream of hot liquid material.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the Republic of Germany Office Action dated Dec. 9, 2008 and the International Search Report dated Aug. 21, 2008 and/or cited elsewhere are hereby incorporated by reference as if set forth in their entirety herein as follows: DE 201 05 716 U1 having the following German title "Gefässfüllmaschine", published on May 29, 2002; DE 196 46 595 A1 having the following English translation of the German title "Bottling machine for filling bottles with drinks", published on May 20, 1998; and EP 1 215 166 A having the following title "Method and device for filling containers with a liquid product", published on Jun. 19, 2002.

Some examples of sterilizing or cleaning agents and concentrations thereof that may possibly be utilized or possibly adapted for use in at least one possible embodiment of the present application may possibly be found in the following U.S. Pat. No. 6,039,922 issued to Swank et al. on Mar. 21, 2000; U.S. Pat. No. 6,244,275 issued to Ziegler et al. on Jun. 12, 2001; U.S. Pat. No. 6,406,666 issued to Cicla et al. on Jun. 18, 2002; and U.S. Pat. No. 6,612,149 issued to Wang et al. on Sep. 2, 2003.

Some examples of electric control valves that may possibly be utilized or possibly adapted for use in at least one possible embodiment of the present application may possibly be found in the following U.S. Pat. No. 4,431,160 issued to Burt et al. on Feb. 14, 1984; and U.S. Pat. No. 4,609,176 issued to Powers on Sep. 2, 1986.

Some examples of control valve apparatus that may possibly be utilized or possibly adapted for use in at least one possible embodiment of the present application may possibly be found in the following U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

U.S. patent application Ser. No. 10/931,817, having the title "Beverage bottling plant for filling bottles with a liquid beverage filling material, having an apparatus for exchanging operating units disposed at rotating container handling machines," and filed on Sep. 1, 2004, is herein incorporated by reference as if set forth in its entirety.

U.S. patent application Ser. No. 12/353,999, having the title "ROTARY BEVERAGE BOTTLE FILLING MACHINE CONFIGURED TO FILL BEVERAGE BOTTLES WITH DIFFERENT DIAMETERS, SIZES, AND SHAPES WITHOUT CHANGING BOTTLE CARRIERS AND A CONTAINER TREATMENT MACHINE CONFIGURED TO HANDLE CONTAINERS WITH DIFFERENT DIAMETERS, SIZES, AND SHAPES WITHOUT CHANGING CONTAINER CARRIERS," and filed on Jan. 15, 2009, is herein incorporated by reference as if set forth in its entirety herein.

U.S. patent application Ser. No. 12/564,290, having the title "FILLING SYSTEM FOR UNPRESSURIZED HOT FILLING OF BEVERAGE BOTTLES OR CONTAINERS IN A BOTTLE OR CONTAINER FILLING PLANT," and filed on Sep. 22, 2009, is herein incorporated by reference as if set forth in its entirety.

U.S. patent application Ser. No. 12/564,499, having the title "FILLING SYSTEM FOR HOT FILLING OF BEVERAGE BOTTLES OR CONTAINERS IN A BOTTLE OR CONTAINER FILLING PLANT," and filed on Sep. 22, 2009, is herein incorporated by reference as if set forth in its entirety.

U.S. patent application Ser. No. 12/616,728, having the title "METHOD OF TREATING A BEVERAGE BOTTLE FILLING MACHINE IN A BEVERAGE BOTTLING PLANT, METHOD OF CLEANING A CONTAINER FILLING MACHINE IN A CONTAINER FILLING PLANT, AND ARRANGEMENTS THEREFOR," and filed on Nov. 11, 2009, is herein incorporated by reference as if set forth in its entirety.

Some examples of one-way valves, which may possibly be utilized or adapted for use in at least one possible embodiment according to the present application, may possibly be found in the following U.S. Pat. No. 7,619,609, having the title "Fluidic display apparatus," published on Nov. 17, 2009; U.S. Pat. No. 7,617,842, having the title "Valves for fuel cartridges," published on Nov. 17, 2009; U.S. Pat. No. 7,617,814, having the title "Fuel pump module having a direct mounted jet pump and methods of assembly," published on Nov. 17, 2009; and U.S. Pat. No. 7,614,708, having the title "Vehicular brake hydraulic control device," published on Nov. 10, 2009.

Some examples of heaters or heat exchangers, cooling systems, valves, pumps, or tanks that may be used or adapted for use in at least one possible embodiment of the present invention may be found in the following U.S. Pat. No. 5,881,952, issued to inventor MacIntyre on Mar. 16, 1999; U.S. Pat. No. 5,862,669, issued to inventors Davis et al. on Jan. 26, 1999; U.S. Pat. No. 5,459,890, issued to inventor Jarocki on Oct. 24, 1995; U.S. Pat. No. 5,367,602, issued to inventor Stewart on Nov. 22, 1994; U.S. Pat. No. 5,319,973, issued to inventors Crayton et al. on Jun. 14, 1994; U.S. Pat. No. 5,226,320, issued to inventors Dages et al. on Jul. 13, 1993; U.S. Pat. No. 5,078,123, issued to inventors Nagashima et al. on Jan. 7, 1992; and U.S. Pat. No. 5,068,030, issued to inventor Chen on Nov. 26, 1991.

The patents, patent applications, and patent publications listed above in the preceding paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 024 106.4, filed on May 22, 2007, having inventors Ludwig CLÜSSERATH and Dieter-Rudolf KRULITSCH, and DE-OS 10 2007 024 106.4 and DE-PS 10 2007 024 106.4, and International Application No. PCT/EP2008/003404, filed on Apr. 26, 2008, having WIPO Publication No. WO2008/141717 A1 and inventors Ludwig CLÜSSERATH and Dieter-Rudolf KRULITSCH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent applications, that is, PCT/EP2008/003404 and Federal Republic of Germany Patent Application No. 10 2007 024 106.4, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the corresponding foreign equivalent patent applications, are not generally considered to be incorporated by reference herein.

Statements made in the original foreign patent applications PCT/EP2008/003404 and Federal Republic of Germany Patent Application No. 10 2007 024 106.4 from which this patent application claims priority which do not have to do with the correction of the translation in this patent application are not to be included in this patent application in the incorporation by reference.

Any statements about admissions of prior art in the original foreign patent applications PCT/EP2008/003404 and Federal Republic of Germany Patent Application No. 10 2007 024 106.4 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

| | |
|---|---|
| 1 | Filling system |
| 2 | Flange |
| 2.1 | Flange |
| 2.2 | Bottle mouth |
| 3 | Filling element |
| 4 | Container holder |
| 5 | Gas lock |
| 6 | Rotor |
| 7 | Housing |
| 8 | Liquid channel |
| 8.1, 8.2 | Segment of liquid channel 8 |
| 9 | Activating mechanism |
| 10 | Liquid valve |
| 11 | Valve body |
| 12 | Flow meter |
| 13 | Line |
| 14 | Kettle |
| 14.1 | Gas space |
| 14.2 | Liquid space |
| 15 | Line |
| 16 | Flow channel |
| 17 | Annular channel |
| 18 | Valve |
| 18.1 | Plunger |
| 18.2 | Membrane |
| 19 | Flow channel |
| 20 | Space |
| 21 | Bell-shaped element |
| 21.1 | Opening of element 21 |
| 22 | Valve |
| 22.1 | Plunger |
| 22.2 | Membrane |

-continued

| | |
|---|---|
| 23 | Line |
| 24 | Electrically operated valve |
| 25 | Closure cap |
| 26 | Gasket ring |

What is claimed is:

1. A container filling arrangement comprising:

a dispensing opening and a liquid channel configured to connect a liquid supply to said dispensing opening;

a liquid valve disposed in said liquid channel;

a first flow channel configured to connect a first portion of said liquid channel to a collecting channel to permit recirculation of liquid, which said first portion is upstream of said liquid valve; and a second flow channel configured to connect a second portion of said liquid channel to said first flow channel, which said second portion is downstream of said liquid valve and adjacent said dispensing opening.

2. The container filling arrangement according to claim 1, wherein:

said container filling arrangement further comprises a first valve disposed in said first flow channel, and a second valve disposed in said second flow channel;

said first valve is configured to be closed upon said liquid valve being opened during container filling, and to be forced open by an increase to a first pressure in said first flow channel generated by a closing of said liquid valve; and said second valve is configured to be closed until forced open by an increase to a second pressure, greater than said first pressure, in said first and second flow channels.

3. The container filling arrangement according to claim 2, wherein:

said container filling arrangement comprises a liquid tank configured to supply heated liquid to said liquid channel, and a collecting channel;

each container filling arrangement comprises a housing, in which are formed said liquid channel, said flow channels, and said dispensing opening;

said liquid valve is openable to permit flow of liquid to said dispensing opening, and closable to prevent flow of liquid to said dispensing opening;

said first flow channel is connected to said first portion of said liquid channel upstream of said liquid valve; and said second flow channel connects said first flow channel to said second portion of said liquid channel to permit flow of cleaning and/or sterilization medium into said second portion of said liquid channel during cleaning and/or sterilizing of said container filling arrangement.

4. The container filling arrangement according to claim 3, wherein:

said first flow channel is connected to said collecting channel to permit cycling of heated liquid from said liquid tank through said liquid channel, said first flow channel, and said collecting channel, and then back to said liquid tank to substantially maintain the temperature of the heated liquid and at least a portion of said container filling arrangement upon said liquid valve being closed;

said container filling arrangement comprises a line connected to said collecting channel; and said line comprises a control valve.

5. The container filling arrangement according to claim 4, wherein at least one of said first and second valves is a check valve or similar valve.

6. The container filling arrangement according to claim 5, wherein at least one of said first and second valves is a pressure limiting valve or similar valve.

7. The container filling arrangement according to claim 6, wherein at least one of said first and second valves comprises a valve that opens and closes when a pressure difference between a valve inlet and a valve outlet goes above or below a threshold value.

8. The container filling arrangement according to claim 7, wherein:

said liquid valve is configured to be moved into a first open position in which said liquid valve is opened sufficient to permit a first flow of liquid therethrough; and said liquid valve is configured to be moved into a second open position in which said liquid valve is opened sufficient to permit a second flow of liquid therethrough, which second flow is greater than said first flow to permit faster container filling.

9. The container filling arrangement according to claim 8, wherein said dispensing opening is configured to be closed by a closure element during cleaning and/or sterilizing of said container filling arrangement.

10. The container filling arrangement according to claim 9, wherein said container filling arrangement comprises a gas lock disposed in said second portion of said liquid channel between said liquid valve and said dispensing opening.

11. The container filling arrangement according to claim 10, wherein said container filling arrangement further comprises a container holder configured to suspend a container being filled.

12. The container filling arrangement according to claim 11, wherein said container holder comprises a closure element configured to close said dispensing opening.

13. The container filling arrangement according to claim 12, wherein said container filling arrangement is configured to perform free-stream or open-jet filling in which the container to be filled is disposed a distance from said dispensing opening during filling.

14. The container filling arrangement according to claim 3, wherein said container filling arrangement comprises a plurality of individual housings, and said liquid tank and said collecting channel are common to all of the housings and the liquid channels and flow channels formed therein.

15. The container filling arrangement according to claim 2, wherein said first valve is configured to be opened upon closing of said liquid valve to permit recirculation of liquid through said first flow channel and ultimately back to a liquid supply to maintain the temperature of the liquid in said container filling arrangement.

16. The container filling arrangement according to claim 15, wherein said second valve is configured to be opened only upon cleaning and/or sterilizing of said container filling arrangement to permit flow of cleaning and/or sterilizing medium into said second portion of said liquid channel.

17. The container filling arrangement according to claim 16, wherein said liquid valve is configured to be closed upon cleaning and/or sterilizing of said container filling arrangement.

18. The container filling arrangement according to claim 17, wherein:

said container filling arrangement comprises a liquid tank configured to supply heated liquid to said liquid channel, and a collecting channel;

said container filling arrangement comprises a line connected to said collecting channel configured to permit recirculation of liquid out of said collecting channel and back to said liquid tank; and said line comprises a control valve.

19. The container filling arrangement according to claim 18, wherein:

at least one of said first and second valves comprises a valve that opens and closes when a pressure difference between a valve inlet and a valve outlet goes above or below a threshold value;

said liquid valve is configured to be moved into a first open position in which said liquid valve is opened sufficient to permit a first flow of liquid therethrough; and said liquid valve is configured to be moved into a second open position in which said liquid valve is opened sufficient to permit a second flow of liquid therethrough, which second flow is greater than said first flow to permit faster container filling.

20. The container filling arrangement according to claim 19, wherein:

said dispensing opening is configured to be closed by a closure element during cleaning and/or sterilizing of said container filling arrangement;

said container filling arrangement comprises a gas lock disposed in said second portion of said liquid channel between said liquid valve and said dispensing opening; and said container filling arrangement is configured to perform free-stream or open-jet filling in which the container to be filled is disposed a distance from said dispensing opening during filling.

* * * * *